US008944725B2

(12) United States Patent
Lazzarin et al.

(10) Patent No.: US 8,944,725 B2
(45) Date of Patent: Feb. 3, 2015

(54) METHOD AND SYSTEM FOR TEMPORARILY SUPPORTING A SOIL MASS SUSCEPTIBLE TO SLIDE

(75) Inventors: Diego Lazzarin, Treviso (IT); Massimo Fontolan, Zero Branco (IT)

(73) Assignee: Saipem S.p.A., San Donato Milanese (IT)

( * ) Notice: Subject to any disclaimer, the term of this patent is extended or adjusted under 35 U.S.C. 154(b) by 282 days.

(21) Appl. No.: 13/062,140

(22) PCT Filed: Sep. 2, 2009

(86) PCT No.: PCT/IB2009/006744

§ 371 (c)(1),
(2), (4) Date: Sep. 15, 2011

(87) PCT Pub. No.: WO2010/026471

PCT Pub. Date: Mar. 11, 2010

(65) Prior Publication Data

US 2012/0057940 A1 Mar. 8, 2012

(30) Foreign Application Priority Data

Sep. 3, 2008 (IT) ..... MI2008A1581

(51) Int. Cl.
*E02D 29/09* (2006.01)
*E02D 17/08* (2006.01)
*E02D 17/04* (2006.01)

(52) U.S. Cl.
CPC ..... *E02D 17/086* (2013.01); *E02D 17/04* (2013.01)
USPC ..... 405/282; 405/283; 405/159; 405/164; 405/165

(58) Field of Classification Search
USPC ..... 405/282, 283, 159, 164, 165; 37/142.5
See application file for complete search history.

(56) References Cited

U.S. PATENT DOCUMENTS

| | | | | | |
|---|---|---|---|---|---|
| 3,347,054 | A * | 10/1967 | Sherrod | 405/164 |
| 3,820,345 | A * | 6/1974 | Brecht | 405/283 |
| 4,338,042 | A * | 7/1982 | Faldi | 405/161 |
| 4,548,528 | A * | 10/1985 | Bell | 405/283 |
| 4,695,204 | A * | 9/1987 | Bell | 405/283 |
| 4,877,355 | A * | 10/1989 | Van Pelt | 405/159 |
| 5,123,785 | A * | 6/1992 | Orfei | 405/283 |
| 5,306,103 | A | 4/1994 | Spencer | |
| 6,220,786 | B1 * | 4/2001 | Ollason et al. | 405/159 |
| 2003/0113092 | A1 * | 6/2003 | Porter | 385/147 |

FOREIGN PATENT DOCUMENTS

| | | |
|---|---|---|
| DE | 90 12 969 U1 | 2/1991 |
| WO | WO 85/04438 A1 | 10/1985 |
| WO | WO 2005/005736 | 1/2005 |

OTHER PUBLICATIONS

International Search Report and Written Opinion from International Application No. PCT/IB2009/006744.

* cited by examiner

*Primary Examiner* — Thomas B Will
*Assistant Examiner* — Katherine Chu
(74) *Attorney, Agent, or Firm* — Dorsey & Whitney LLP

(57) ABSTRACT

A method of temporarily supporting a soil mass susceptible to slide at a scarp slope bounding the soil mass includes advancing a supporting wall in an advancing direction along the scarp slope; and, in addition to the movement in the advancing direction, also moving a surface portion, in direct contact with the soil mass, of the supporting wall, so as to minimize friction between the soil mass and the supporting wall.

22 Claims, 6 Drawing Sheets

1
2
3
4
5
6
7
8
9
10
11
14
15
16
17
18
19
20
21
22
23
24
29
30
32
35
36
37
SL
P
D1
D2
S
A1

D2
A1
4
6
7
8
9
10
19
20
21
22
23
24
28
29
30
32
33
35
36
37

2
4
A1
B
C
12
13
14
18
P
S

METHOD AND SYSTEM FOR TEMPORARILY SUPPORTING A SOIL MASS SUSCEPTIBLE TO SLIDE

CROSS-REFERENCE TO RELATED APPLICATIONS

This application is a U.S. Nationalization of PCT International Application No. PCT/IB2009/006744 filed 2 Sep. 2009, which claims priority to Italian Patent Application No. MI2008A001581 filed 3 Sep. 2008, the entireties of both of the foregoing applications are incorporated herein by reference.

TECHNICAL FIELD

One or more embodiments of the present invention relate to a method of temporarily supporting a soil mass susceptible to slide, in particular, susceptible to slide at a scarp slope bounding the soil mass.

More specifically, the one or more embodiments of the present invention relate to a method comprising the step of advancing a supporting wall in an advancing direction along a scarp slope of the soil mass.

The method according to one or more embodiments of the present invention applies in particular to the laying of continuous elongated members, such as underwater pipelines, cables, umbilicals, pipe and/or cable bundles, in the bed of a body of water.

BACKGROUND ART

In-bed laying underwater pipelines is commonly known as "underground laying", and comprises laying the pipeline along a given path on the bed of the body of water; fragmenting a soil mass along the path to a given depth; digging a trench or generally removing the fragmented soil mass; and possibly burying the pipeline.

More specifically, currently used known techniques comprise removing the fragmented soil mass to form a trench in the bed of the body of water; and lowering the pipeline into the trench. The pipeline may later be covered over with the removed soil mass to fill in the trench and bury the pipeline.

Underwater pipelines carrying hydrocarbons are normally laid completely or partly underground for various reasons, some of which are discussed below. Underwater pipelines are normally laid underground close to shore approaches and in relatively shallow water, to protect them from damage by blunt objects, such as anchors or nets, and are sometimes laid underground to protect them from natural agents, such as wave motion and currents, which may result in severe stress. That is, when a pipeline is laid on the bed of a body of water, it may span two supporting areas of the bed, i.e. a portion of the pipeline may be raised off the bed; in which case, the pipeline is dangerously exposed to, and offers little resistance to the movements induced by, wave motion and currents. Underground laying may also be required for reasons of thermal instability, which result in deformation (upheaval/lateral buckling) of the pipeline, or to protect the pipeline from the mechanical action of ice, which, in particularly shallow water, may result in scouring of the bed.

To avoid damage, the pipeline often need simply be laid at the bottom of a suitably deep trench dug before laying (pre-trenching) or more often after laying the pipeline (post-trenching). At times, the protection afforded by the trench and eventual natural backfilling of the trench is not enough, and the pipeline must be buried using the fragmented soil mass removed from the trench, or any available soil mass alongside the trench.

The depth of the trench is normally such that the top line of the pipeline is roughly a meter below the surface of the bed, though severe environmental conditions may sometimes call for deeper trenches (of several metres). Trenching and backfilling are performed using digging equipment, and post-trenching (with the pipeline already laid on the bed) is the normal practice, to dig and backfill the trench in one go.

One method of in-bed laying underwater pipelines is described in Patent Application WO 2005/005736. This is a post-trenching method comprising the steps of fragmenting a soil mass in the bed to open the way; and drawing along the opening a huge plough, to form a trench, and vertical supporting walls connected to the plough and which respectively support two opposite soil masses bounded by two substantially vertical scarp slopes.

The above method has the drawback of being highly energy-intensive, due partly to the plough, and partly to friction between the supporting walls and the two soil masses. Energy consumption also increases exponentially alongside an increase in trench depth.

SUMMARY

One or more embodiments of the present invention provide a method of temporarily supporting a soil mass susceptible to slide, designed to eliminate the drawbacks of the known art.

According to an embodiment of the present invention, there is provided a method of temporarily supporting a soil mass susceptible to slide; the method including the steps of advancing a supporting wall in an advancing direction along a scarp slope bounding said soil mass; and additionally moving at least a surface portion, in direct contact with the soil mass, of the supporting wall, so as to minimize friction between the soil mass and the supporting wall in the advancing direction.

One or more embodiments of the present invention provide for greatly reducing friction, and so reducing the energy required to advance the supporting wall with respect to the soil mass.

One or more embodiments of the present invention also relate to a system for temporarily supporting a soil mass susceptible to slide.

According to an embodiment of the present invention, there is provided a system for temporarily supporting a soil mass susceptible to slide; the soil mass being bounded by a scarp slope; and the system comprising means for advancing a supporting wall in an advancing direction along the scarp slope; and means for additionally moving at least a surface portion, in direct contact with the soil mass, of the supporting wall, so as to minimize friction between the soil mass and the supporting wall in the advancing direction.

BRIEF DESCRIPTION OF THE DRAWINGS

A number of non-limiting embodiments of the present invention will be described by way of example with reference to the accompanying drawings, in which.

DETAILED DESCRIPTION

Figure 1:
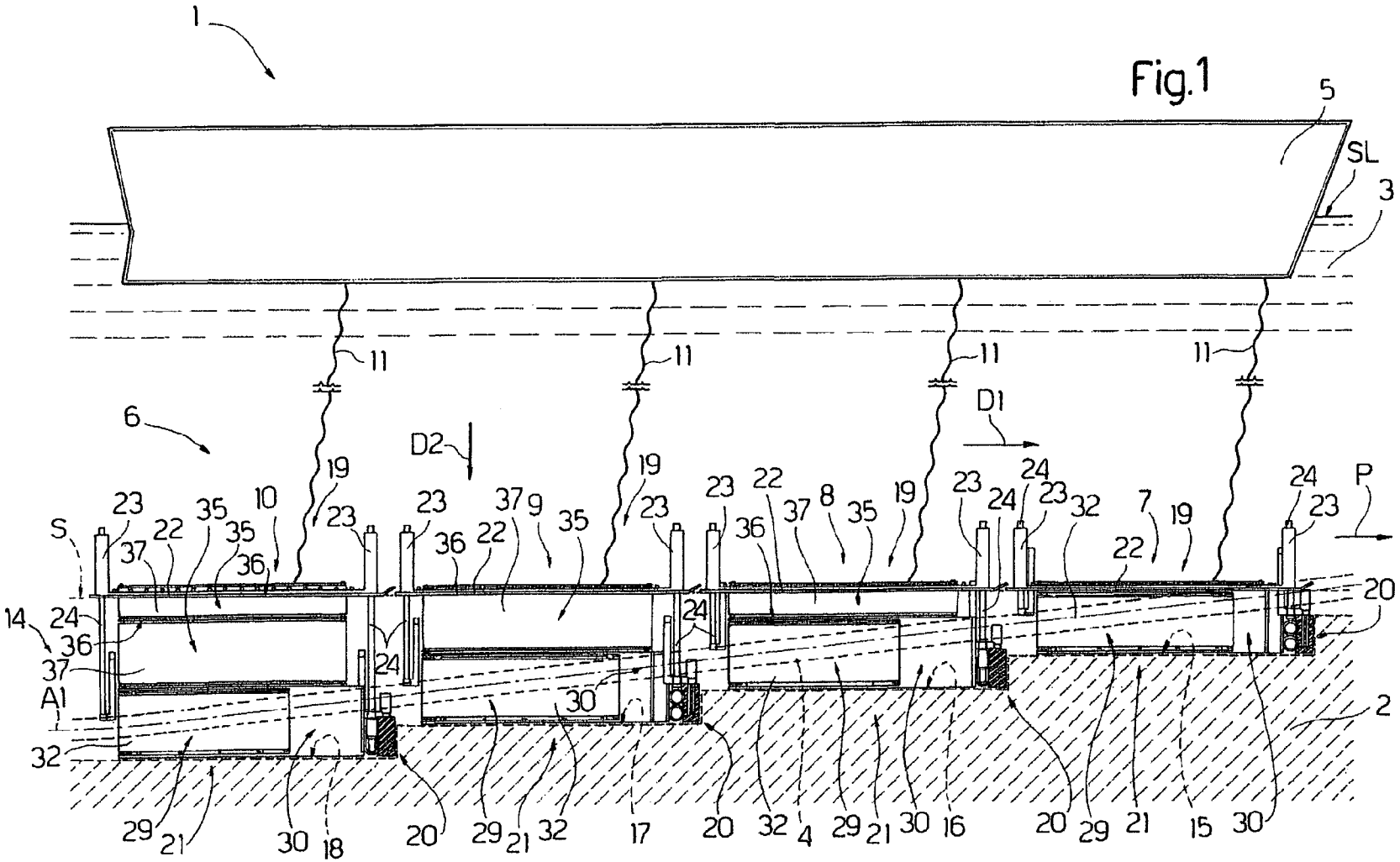
FIG. 1 shows a partly sectioned side view, with parts removed for clarity, of a system for laying underwater pipelines in the bed of a body of water.

Number 1 in FIG. 1 indicates a system for laying underwater pipelines in a bed 2 of a body of water 3.

In the following description, the term "body of water" is intended to mean any stretch of water, such as sea, ocean, lake, etc., and the term "bed" is intended to mean the concave layer of the earth's crust containing the mass of water in the body at a level SL.

Laying system 1 comprises a known laying vessel (not shown) for laying an underwater pipeline 4, of axis A1, along a given path P on bed 2; a support vessel 5; and a convoy 6 comprising a number of vehicles 7, 8, 9, 10 advanced in a direction D1 along path P.

Vehicles 7, 8, 9, 10 are underwater vehicles guidable along path P. More specifically, support vessel 5 serves to guide vehicles 7, 8, 9, 10 along path P, and to supply vehicles 7, 8, 9, 10 with electric power, control signals, compressed air, hydraulic power, etc., so each vehicle 7, 8, 9, 10 is connected to support vessel 5 by a cable bundle 11.

Figures 2, 3:
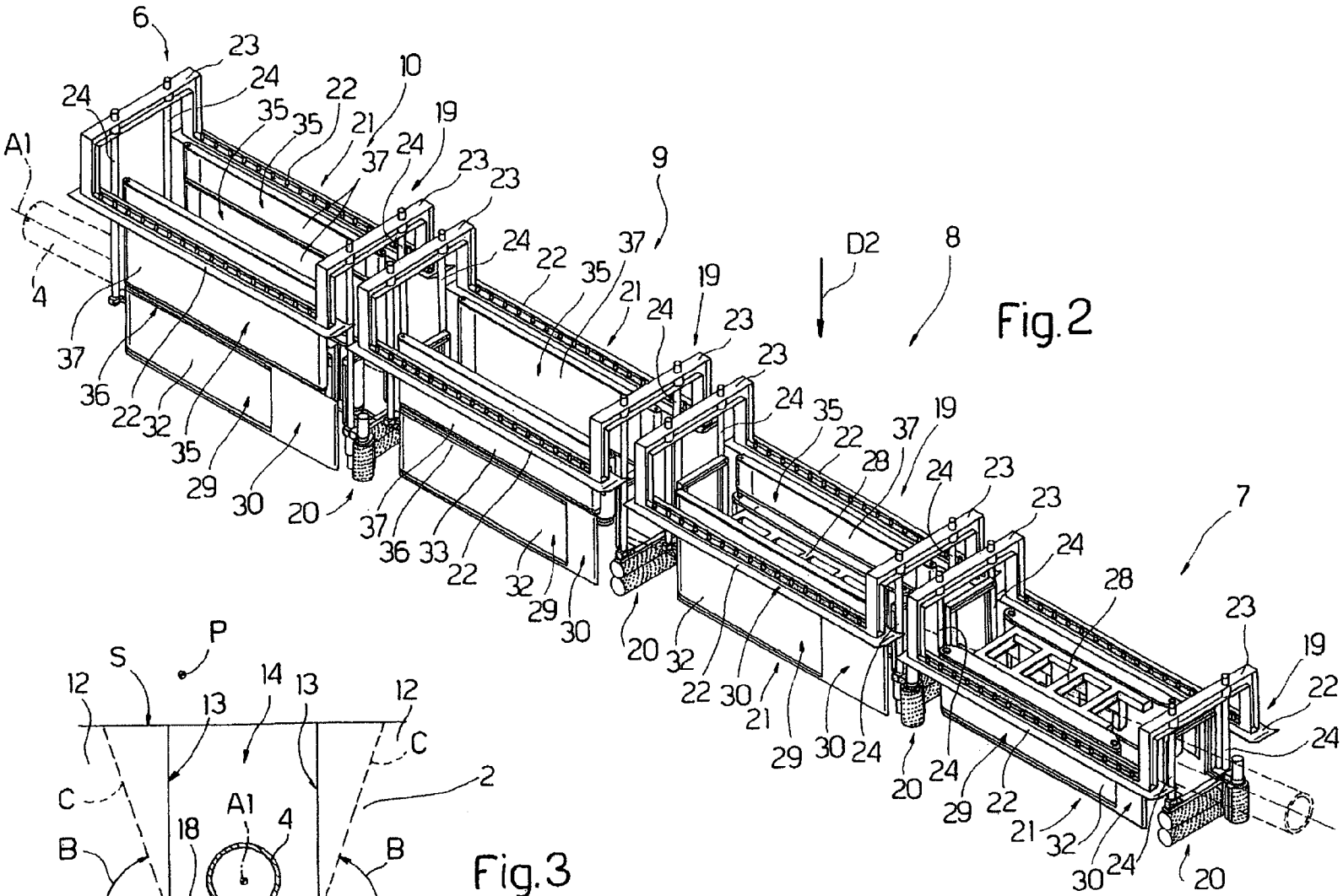
FIG. 2 shows an isometric view, with parts removed for clarity, of a convoy of the FIG. 1 system.
FIG. 3 shows a cross section, with parts removed for clarity, of the bed of a body of water.

Each vehicle 7, 8, 9, 10 serves to fragment a respective soil layer of bed 2 to form two soil masses 12, bounded by respective opposite, substantially vertical scarp slopes 13, as shown clearly in FIG. 3, and a fragmented soil mass 14 between the two scarp slopes 13; to support soil masses 12 along scarp slopes 13; and to aid in sinking pipeline 4 into the fragmented soil mass 14 between the two opposite scarp slopes 13.

With reference to FIG. 1, the fragmented soil mass 14 is bounded at the bottom by bottom faces 15, 16, 17, 18 decreasing gradually in depth in direction D1.

With reference to FIG. 3, bottom face 18 is the laying plane of pipeline 4. In other words, fragmenting part of the soil of bed 2 along path P alters the structure of bed 2 and forms the two soil masses 12 connected to bottom face 18 by respective scarp slopes 13. For the purpose of this description, the term "scarp slope" is intended to mean a surface connecting rock formations, sediment or terrains at different heights, regardless of whether or not the fragmented soil mass 14 is removed.

With reference to FIG. 3, even though the fragmented soil mass 14 is preferably not substantially removed from bed 2, soil masses 12 are susceptible to slide at respective scarp slopes 13. The slide tendency of each soil mass 12 depends on the slope of respective scarp slope 13, and on the structure, particle size and cohesion of soil mass 12.

For example, a soil mass of granular material, such as sand or gravel, tends to settle into a surface (natural slope) at a given angle, known as natural slope angle, to the horizontal. Assuming the material of bed 2 has a natural slope angle B defining surfaces C in soil masses 12, it is fairly accurate to assume the parts of soil masses 12 that would slide when unconfined would be those between surfaces C and scarp slopes 13.

If bed 2 is made solely of cohesive rock, on the other hand, the FIG. 3 model no longer applies. Nevertheless, laying system 1 (FIG. 1) is designed to cope with any type of problem, regardless of the geological structure of bed 2.

If left in place, the fragmented soil mass 14 acts as a support for adjacent soil masses 12.

Soil masses 12, however, are still capable of yielding to a certain extent along respective scarp slopes 13, which would still impair the sinking of pipeline 4.

In an alternative embodiment, the fragmented soil mass is removed by dredge pumps (not shown), in which case, soil masses 12 are most likely to slide at the respective scarp slopes, especially in the case of cohesionless soil.

With reference to FIG. 2, each vehicle 7, 8, 9, 10 comprises a supporting frame 19; a soil-fragmenting tool assembly 20; a caisson 21 for supporting soil masses 12; and a device (not shown) for fluidifying the fragmented soil mass 14 (FIG. 3) to induce sinking of pipeline 4 into fragmented soil mass 14.

Figure 4:
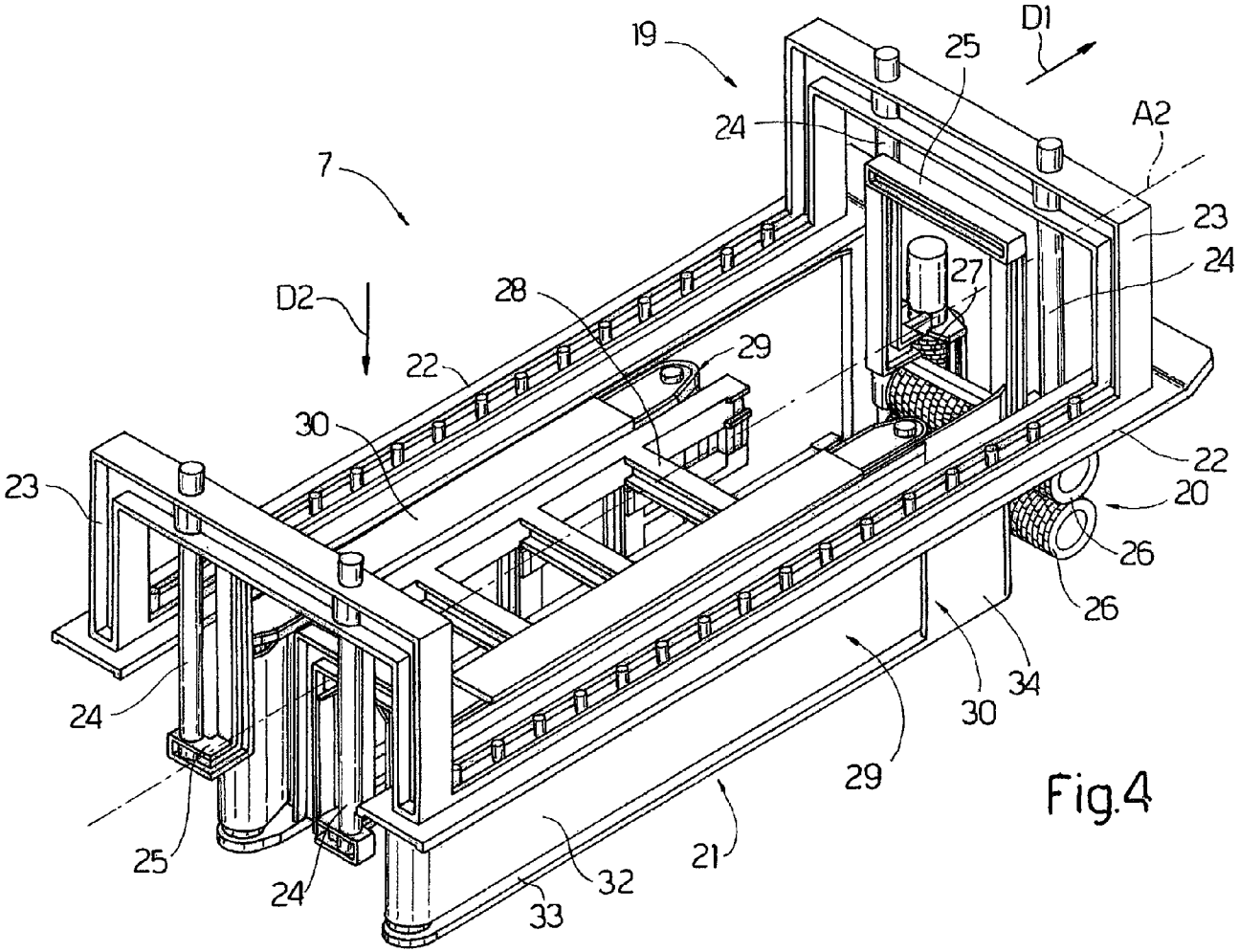
FIG. 4 shows a larger-scale isometric view, with parts removed for clarity, of a vehicle forming part of the FIG. 2 convoy.

With reference to FIG. 4 and specifically to vehicle 7, supporting frame 19 extends along an axis A2 and comprises two skids 22 parallel to axis A2 and which rest on the surface S of bed 2, as shown more clearly in FIG. 5; two gantry structures 23 connecting opposite skids 22; four bars 24 fixed in pairs to gantry structures 23; and two underframes 25, each fixed to a pair of bars 24 and located below skids 22.

Tool assembly 20 for fragmenting bed 2 is located under skids 22, and comprises a number of powered cutters 26, 27 for fragmenting a layer of bed 2 along path P. In the example shown, tool assembly 20 comprises two cutters 26 arranged one over the other, with respective substantially horizontal axes parallel to each other; and a cutter 27 located next to cutters 26, with its axis perpendicular to the axes of cutters 26, so as to define with cutters 26 a rectangular work section substantially equal to the sum of the work sections of cutters 26 and 27. Tool assembly 20 is fitted to one of underframes 25, is located at the front of vehicle 7, and is movable selectively in a direction D2 perpendicular to direction D1 and substantially perpendicular to the top surface of bed 2. In other words, underframes 25 are powered and movable along bars 24 to adjust the depth of caisson 21 as a whole and of fragmenting tools 20.

Figure 5:
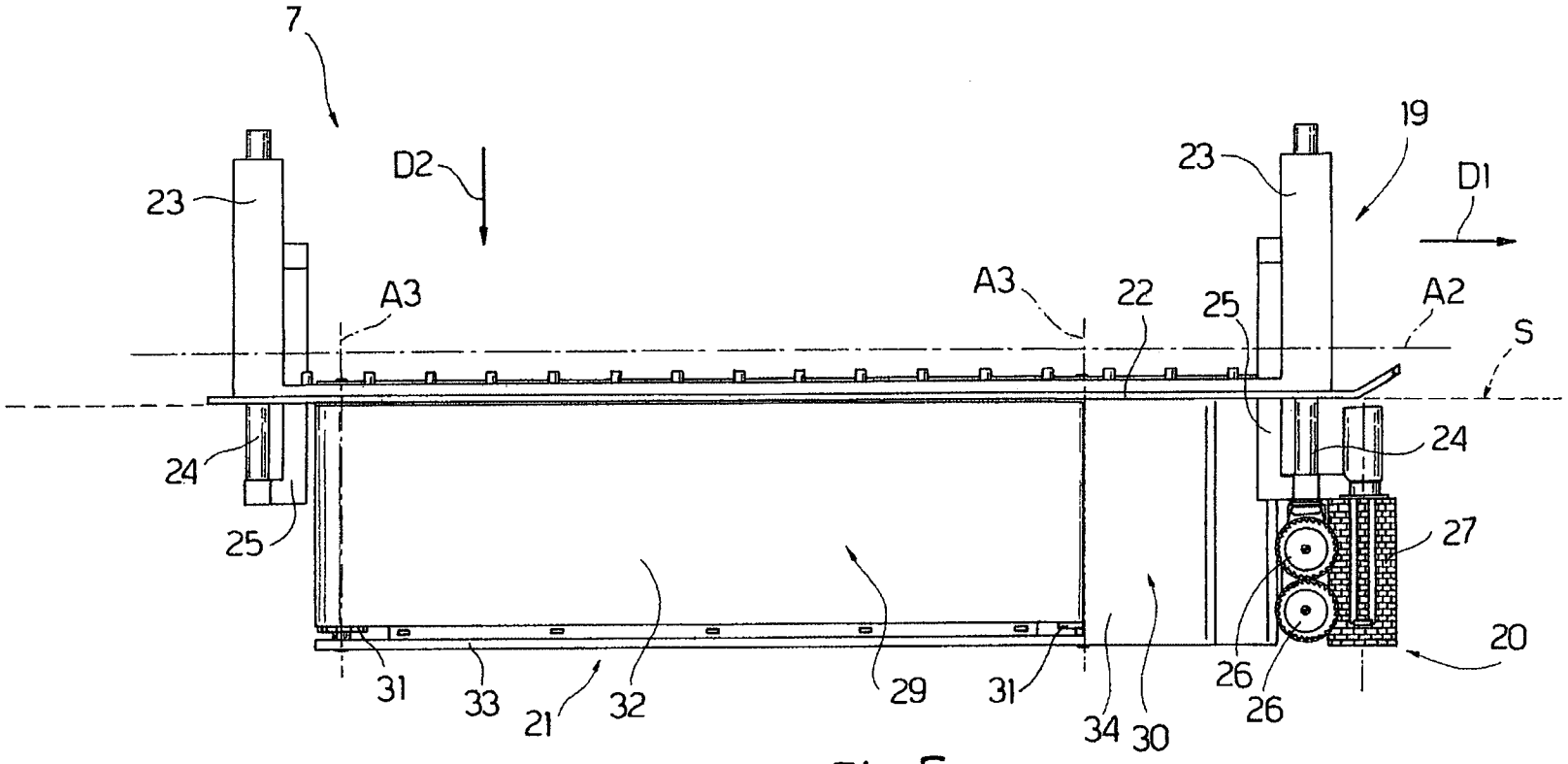
FIG. 5 shows a side view, with parts removed for clarity, of the FIG. 4 vehicle.

As shown in FIG. 5, tool assembly 20 is located well below surface S of bed 2. The top part of bed 2 not fragmented directly by cutters 26 and 27 is fragmented by yielding under the weight of pipeline 4 and by agitation of fragmented soil mass 14 underneath.

In an alternative embodiment not shown, a seat is dug along the path, in which to later lay the pipeline.

Figure 6:
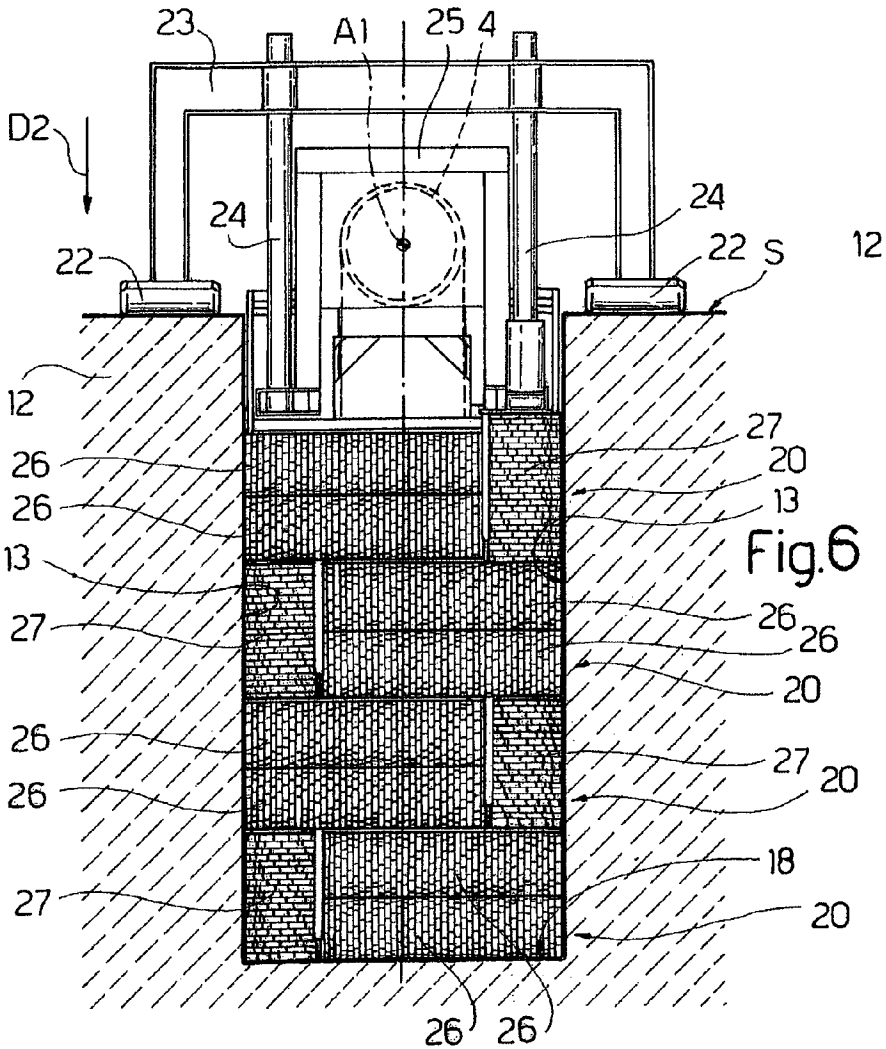
FIG. 6 shows a partly sectioned front view, with parts removed for clarity, of the FIG. 2 convoy laying the underwater pipeline in the bed.

Caisson 21 comprises a frame 28; and two opposite supporting walls 29 fitted to frame 28 to support soil masses 12 along respective scarp slopes 13, as shown in FIG. 6. Frame 28 and supporting walls 29 form a tunnel which, in use, is located under frame 19 and below skids 22, i.e. is completely immersed in fragmented soil mass 14.

Figure 7:
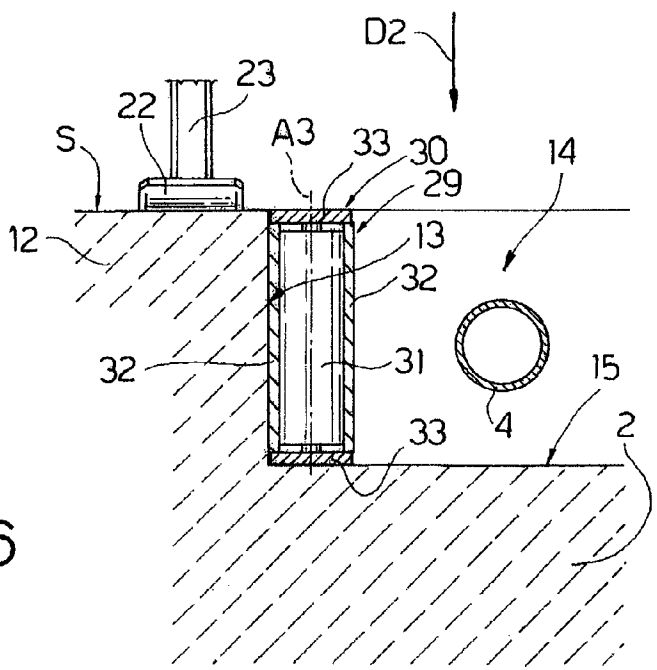
FIG. 7 shows a front cross section, with parts removed for clarity, of the FIG. 4 vehicle laying the underwater pipeline in the bed.

With reference to FIG. 7, each supporting wall 29 comprises a base structure 30 in turn comprising a number of aligned rollers 31 (only one shown in FIG. 7) rotating about respective axes A3 parallel to direction D2; and a powered crawler 32 looped about base structure 30 to define a surface portion, contacting scarp slope 13, of supporting wall 29.

Supporting structure 30 comprises two plates 33, between which rollers 31 (only one shown) extend to guide crawler 32. The two plates 33 are connected to one another by a panel 34 parallel to powered crawler 32, as shown in FIGS. 4 and 5. In other words, each supporting wall 29 comprises a powered crawler 32, which contacts soil mass 12 along scarp slope 13, moves vehicle 7 in advancing direction D1, and contacts fragmented soil mass 14 on the opposite side.

A fluidifying device (not shown) is mounted on each vehicle 7, 8, 9, 10, and serves to inject water jets into fragmented soil mass 14 (FIG. 1), and to dredge fragmented soil mass 14 (FIG. 1) without expelling it from caisson 21. In other words, the fluidifying device (not shown) churns up fragmented soil mass 14 (FIG. 1) to induce natural sinking of pipeline 4 into fragmented soil mass 14.

Vehicle 8 differs from vehicle 7 by frame 19 comprising four bars 24 longer than bars 24 of vehicle 7; by tool assembly 20 and caisson 21 being located deeper inside bed 2 (FIG. 1); and by comprising two further supporting walls 35, each substantially aligned with and above supporting wall 29 and above frame 28 (FIG. 2). Each supporting wall 35 comprises a base structure 36; a number of rollers (not shown) rotating about respective axes parallel to axes A3; and a powered crawler 37 looped about base structure 36 and contacting scarp slope 13 (FIG. 2).

Vehicle 9 differs from vehicle 8 by having bars 24 longer than bars 24 of vehicle 8; by tool assembly 20 and caisson 21 being located deeper; and by supporting walls 35 being higher.

Likewise, vehicle 10 differs from vehicle 9 by having bars 24 longer than bars 24 of vehicle 9; by tool assembly 20 and caisson 21 being located deeper; and by comprising two further supporting walls 35.

Vehicles 7, 8, 9, 10 fragment soil mass 14, which extends to a considerable depth and has an overall cross section defined by the width of bottom face 18 (FIG. 3) and the height of scarp slopes 13. The cross section shown in FIG. 3 is particularly high and narrow, is two and a half times as wide and five times as deep as the diameter of pipeline 4, and is formed by a combination of tool assemblies 20 of vehicles 7, 8, 9, 10 (FIG. 6).

In this case, sinking pipeline 4 would be comprised by any yielding of soil masses 12. One of the functions of caissons 21 is to confine the fluidified area, which, should it also extend to the surrounding soil, could impair sinking pipeline 4 or result in greater energy consumption to fluidify a larger fragmented soil mass.

According to an embodiment of the present invention, when sinking pipeline 4 in fragmented soil mass 14, soil masses 12 are supported temporarily by supporting walls 29 and 35, and vehicles 7, 8, 9, 10 are driven forward by supporting walls 29, so friction between supporting walls 29 and soil masses 12 is rolling as opposed to sliding. Once pipeline 4 is sunk and supporting walls 29 and 35 move forward, soil masses 12 are allowed to slide, even though supported to a certain extent by fragmented soil mass 14.

Any mudslide after pipeline 4 is sunk is beneficial by assisting burial of pipeline 4.

Figure 8:
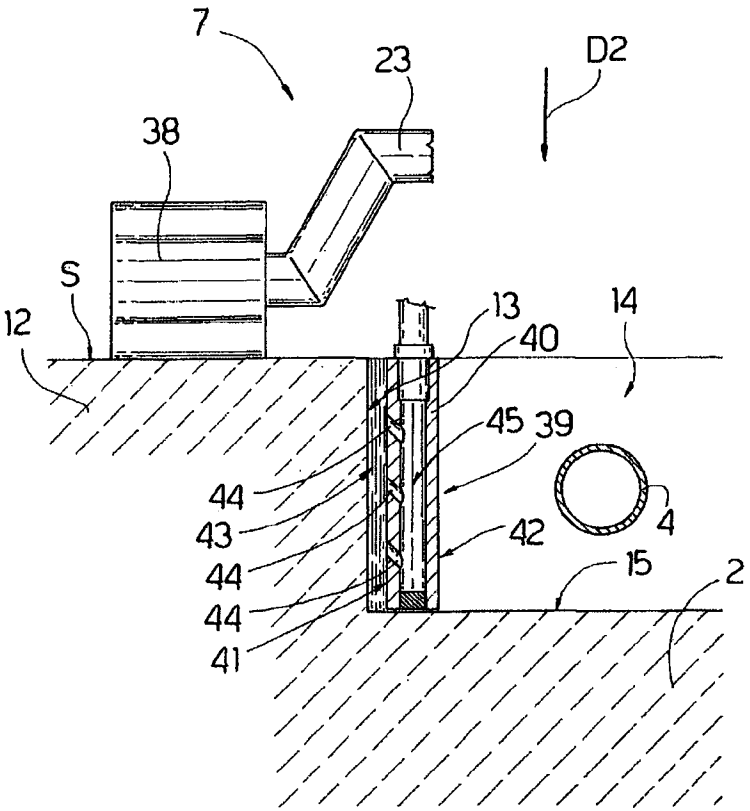
FIG. 8 shows a front cross section, with parts removed for clarity, of an alternative embodiment of the FIG. 4 vehicle laying the underwater pipeline.

In the embodiment shown in FIG. 8 embodiment, skids 22 of vehicle 7 in FIG. 4 are replaced by powered crawlers 38, and supporting walls 39 are substituted for supporting walls 29.

Each supporting wall 39 comprises a base structure defined by a panel 40 having two opposite faces 41, 42 and, in use, a surface portion defined by a liquid film 43 along face 41. Face 41 faces scarp slope 13 of one of soil masses 12, and face 42 contacts fragmented soil mass 14.

Vehicle 7 is advanced by powered crawlers 38.

To form liquid film 43, each panel 40 comprises a number of nozzles 44 arranged along face 41; and a number of conduits 45 housed inside panel 40 to supply nozzles 44 with liquid. Conduits 45 are supplied with liquid by preferably centrifugal pumps (not shown) mounted on vehicle 7 and which pump water directly from the body of water.

Nozzles 44 are oriented to direct the liquid along face 41 in a preferential direction preferably opposite advancing direction D1.

Supporting wall 39 therefore does not aid in advancing vehicle 7, but greatly reduces friction between panel 40 and soil mass 12.

In the embodiment shown in FIG. 8 embodiment, vehicles 8, 9, 10 in FIG. 2 are also modified in the same way as vehicle 7 in FIG. 8. That is, both supporting walls 29 and supporting walls 35 are replaced with supporting walls 39 as described above.

Figure 9:
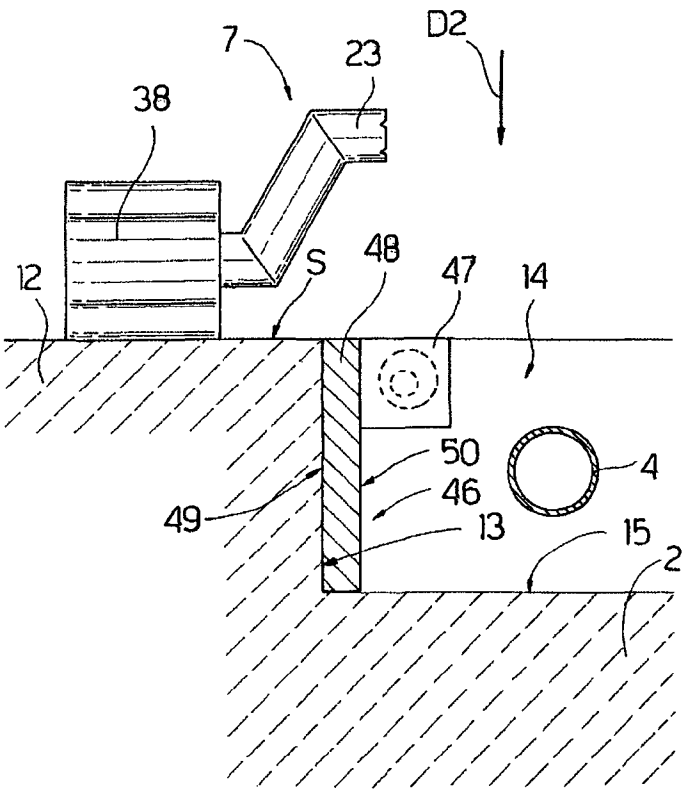
FIG. 9 shows a front cross section, with parts removed for clarity, of another alternative embodiment of the FIG. 4 vehicle laying the underwater pipeline.

In the embodiment shown in FIG. 9, skids 22 of vehicle 7 in FIG. 4 are replaced with powered crawlers 38; supporting walls 29 are replaced with supporting walls 46; and vehicle 7 preferably comprises a vibrating device 47 for each supporting wall 46.

Each supporting wall 46 comprises a panel 48 having two opposite faces 49 and 50: face 49 faces the scarp slope 13 of one of soil masses 12; and face 50 faces fragmented soil mass 14.

Vibrating device 47 is fitted directly to panel 48, as shown in FIG. 9, and comprises, for example, a motor (not shown) for rotating an eccentric mass.

The vibration induced in panels 48 reduces friction between panels 48 and soil masses 12, and eases the forward movement of vehicle 7.

In the embodiment shown in FIG. 9, vehicles 8, 9, 10 in FIG. 2 are also modified in the same way as vehicle 7 in FIG. 9. That is, both supporting walls 29 and supporting walls 35 are replaced with supporting walls 46 as described above.

In the example described with reference to the attached drawings, fluidification to induce sinking of pipeline 4 is achieved by a combination of water jets and hydrodynamic suction underneath the pipeline. This is the preferred method of sinking pipeline 4, and gives excellent results regardless of the type of soil. Possible variations of the method comprise removing all or part of the fragmented soil mass using dredge pumps (not shown); in which case, without the aid of fragmented soil mass 14 between the two scarp slopes 13 of soil masses 12, caissons 21 described are even more essential to prevent slide of soil masses 12 until pipeline 4 is laid on bottom face 18.

In another variation, the soil-working and burying vehicles are manned, as opposed to being controlled from the support vessel.

The advantages of at least some of the embodiments of the present invention substantially consist in enabling laying of an underwater pipeline in the bed of a body of water with less energy consumption as compared with conventional technology, while at the same time preventing the soil masses formed from sliding and so compromising or, more importantly, bringing work to a halt.

Though the above description refers specifically to an underwater pipeline, the present invention also applies to laying continuous elongated members, such as cables, umbilicals, pipe and/or cable bundles, in the bed of a body of water.

The invention claimed is:

1. A method of temporarily supporting a soil mass susceptible to slide, the method comprising:

positioning a plurality of supporting walls at least partially below a surface of a bed of a body of water, the plurality of supporting walls including one or more support surfaces supporting a soil mass along a scarp slope within the bed;

maintaining relative position of each of the one or more support surfaces of the plurality of support walls relative to a crawler positioned above the plurality of supporting walls and connected thereto, while advancing the crawler together with the plurality of supporting walls in an advancing direction along the scarp slope bo6unding the soil mass; and vibrating each of the plurality supporting walls in a direction crosswise to the advancing direction to reduce friction between the support surface of the supporting wall and the soil mass along the scarp slope, while advancing the crawler together with the plurality of supporting walls.

2. The method according to claim 1, further comprising directing liquid via conduits and nozzles between the support surface of the supporting wall and the soil mass in a direction opposite to the advancing direction.

3. The method according to claim 2, further comprising forming a film between the support surface of the supporting wall and the soil mass.

4. The method according to claim 1, further comprising moving at least a portion of the support surface of the supporting wall in a direction opposite to the advancing direction.

5. The method according to claim 1, further comprising churning fragmented soil mass by injecting water jets into the fragmented soil mass.

6. The method according to claim 5, further comprising sinking a continuous elongated member into the fragmented soil mass.

7. The method according to claim 1, wherein advancing the supporting wall in an advancing direction along the scarp slope bounding the soil mass comprises moving a crawler in the advancing direction on a top surface of the bed, the crawler being connected to the supporting wall.

8. The method according to claim 1, wherein vibrating the supporting wall in a direction crosswise to the advancing direction comprises rotating an eccentric mass about an axis of rotation oriented along the advancing direction.

9. A system for temporarily supporting a soil mass of a bed of a body of water, the soil mass being susceptible to slide and being bounded by a scarp slope, the system comprising:

one or more vehicles advancable in an advancing direction on the bed of the body of water, each of the one or more vehicles including:

a plurality of supporting walls each having a support surface configured to support the soil mass that is bounded by the scarp slope;

a mechanism for maintaining relative position of each of the support surfaces of the plurality of supporting walls relative to the one or more vehicles in a manner that all of the support surfaces of the plurality of supporting walls are advancable together with the one or more vehicles in the advancing direction along the scarp slope;

a mechanism for securing the plurality of supporting walls at a predetermined depth within the bed relative to a top surface thereof, the mechanism for securing the plurality of supporting walls being connected to the each of the plurality of supporting walls and being positioned and oriented to rest on the top surface of the bed; and a vibrating device fitted directly to each of the plurality of the supporting walls and configured to vibrate the each of the plurality of supporting walls crosswise to the advancing direction.

10. The system according to claim 9, wherein the mechanisms for advancing the supporting wall and for supporting the supporting wall at the predetermined depth within the bed relative to the top surface thereof include a powered crawler configured to move on the top surface of the bed.

11. The system according to claim 9, further comprising conduits and nozzles positioned and oriented to feed the liquid along the face of the supporting wall in a direction opposite to the advancing direction, to form a liquid film between the support surface and the soil mass.

12. The system according to claim 9, further comprising fragmenting device for forming a fragmented soil mass along a path in a bed of a body of water, so as to substantially simultaneously form two soil masses located on opposite sides of the fragmented soil mass, adjacent to the fragmented soil mass, and bounded by two respective scarp slopes;

each soil mass being susceptible to slide at the respective scarp slope.

13. The system according to claim 12, further comprising a caisson comprising two supporting walls, each supporting wall supporting at least a portion of a respective soil mass along a respective scarp slope.

14. The system according to claim 9, further comprising a plurality of vehicles forming a convoy; the fragmenting device and the respective caissons of the plurality of vehicles being located at depths decreasing in the advancing direction of the convoy.

15. The system according to claim 9, further comprising a plurality of powered cutters for fragmenting soil.

16. The system according to claim 9, wherein the support surface is movable in a direction opposite to the advancing direction.

17. The system according to claim 16, wherein the mechanism for securing the supporting wall at a predetermined depth within the bed of the body of water relative to a top surface thereof includes one or more skids connected to the supporting wall.

18. A system for temporarily supporting a soil mass of a bed of a body of water, the soil mass being susceptible to slide and being bounded by a scarp slope, the system comprising:

one or more vehicles advancable in an advancing direction on the bed of the body of water, each of the one or more vehicles including:

a crawler configured to move on a top surface of the bed in the advancing direction;

plurality of panels connected to the crawler, each of the plurality of panels being positioned below the crawler and having a face sized and configured to support the soil mass that is bounded by the scarp slope, each face being maintained at a fixed position relative to the crawler; and a vibrating mechanism connected to at least one of the one or more panels, the vibrating mechanism being configured to vibrate the at least one panel crosswise to the advancing direction during advancement thereof together with the crawler.

19. The system according to claim 18, further comprising a plurality of nozzles arranged along each face and oriented to direct liquid along the face and in a direction opposite to the advancing direction.

20. The system according to claim 18, further comprising a plurality of powered cutters for fragmenting soil, the plurality of powered cutters being connected to the one or more panels below the crawler.

21. The system according to claim 20, further comprising a fluidifying device configured to inject water jets into fragmented soil.

22. The system according to claim 18, wherein the vibrating mechanism includes a rotatable eccentric mass having an axis of rotation oriented along the advancing direction.

* * * * *

UNITED STATES PATENT AND TRADEMARK OFFICE

CERTIFICATE OF CORRECTION

PATENT NO. : 8,944,725 B2
APPLICATION NO. : 13/062140
DATED : February 3, 2015
INVENTOR(S) : Lazzarin et al.

It is certified that error appears in the above-identified patent and that said Letters Patent is hereby corrected as shown below:

In the Claims

In Column 7, Claim 1, Line 9, delete “bo6unding” and insert -- bounding --, therefor.

In Column 7, Claim 1, Line 11, delete “plurality supporting” and insert -- plurality of supporting --, therefor.

In Column 8, Claim 18, Line 50, delete “plurality” and insert -- a plurality --, therefor.

Signed and Sealed this
Twenty-first Day of July, 2015

Michelle K. Lee

Michelle K. Lee
*Director of the United States Patent and Trademark Office*